US009685287B2

(12) United States Patent
Maloney

(10) Patent No.: US 9,685,287 B2
(45) Date of Patent: Jun. 20, 2017

(54) CIRCUIT BREAKERS WITH MOVING CONTACT HAVING HEEL-TOE ACTION

(71) Applicant: Eaton Corporation, Cleveland, OH (US)

(72) Inventor: James Gerard Maloney, Industry, PA (US)

(73) Assignee: Eaton Corporation, Cleveland, OH (US)

( * ) Notice: Subject to any disclaimer, the term of this patent is extended or adjusted under 35 U.S.C. 154(b) by 107 days.

(21) Appl. No.: 14/559,276

(22) Filed: Dec. 3, 2014

(65) Prior Publication Data

US 2016/0163482 A1 Jun. 9, 2016

(51) Int. Cl.

| | |
|---|---|
| ***H01H 75/00*** | (2006.01) |
| ***H01H 33/42*** | (2006.01) |
| ***H01H 33/08*** | (2006.01) |
| ***H01H 9/34*** | (2006.01) |
| ***H01H 71/52*** | (2006.01) |
| *H01H 1/023* | (2006.01) |

(52) U.S. Cl.

CPC ..... *H01H 33/42* (2013.01); *H01H 9/34* (2013.01); *H01H 33/08* (2013.01); *H01H 71/522* (2013.01); *H01H 1/023* (2013.01); *H01H 2235/01* (2013.01)

(58) Field of Classification Search

CPC ..... H01H 3/60
USPC ..... 335/15, 38, 6, 46
See application file for complete search history.

(56) References Cited

U.S. PATENT DOCUMENTS

| | | | | |
|---|---|---|---|---|
| 847,520 | A * | 3/1907 | Smythe et al. | H01H 71/2472 200/500 |
| 1,030,435 | A * | 6/1912 | Schureman | H01H 50/323 335/161 |
| 1,122,430 | A * | 12/1914 | Scott | H01H 71/501 335/166 |
| 3,020,374 | A * | 2/1962 | Tootelian | H01H 1/54 218/16 |
| 3,076,882 | A | 2/1963 | Judd et al. | |
| 3,585,329 | A | 6/1971 | Walker et al. | |
| 3,605,051 | A * | 9/1971 | Casey | H01H 71/501 335/166 |
| 3,783,215 | A * | 1/1974 | Brumfield | H01H 71/501 200/401 |
| 3,849,751 | A * | 11/1974 | Link | H01H 71/1054 200/401 |
| 4,081,852 | A * | 3/1978 | Coley | H02H 3/105 335/37 |
| 4,346,356 | A * | 8/1982 | Fujiwara | H01H 71/503 335/14 |

(Continued)

FOREIGN PATENT DOCUMENTS

WO WO2014/088714 6/2014

OTHER PUBLICATIONS

Non-final Office Action corresponding to U.S. Appl. No. 14/698,192 (16 pages) (mailed Aug. 11, 2016).

*Primary Examiner* — Alexander Talpalatski
(74) *Attorney, Agent, or Firm* — Myers Bigel, P.A.

(57) ABSTRACT

Circuit breakers with moving contacts having heel-toe action are configured to direct arcing across a small portion of a stationary contact surface to an adjacent arc chute to thereby alleviate deterioration due to arcing and improve conductivity of a major portion of the stationary contact and moving contact surface over time.

22 Claims, 10 Drawing Sheets

(56) References Cited

U.S. PATENT DOCUMENTS 4,489,295 A * 12/1984 Altenhof, Jr. ..... H01H 71/1054 335/166
4,503,408 A 3/1985 Mrenna et al.
4,736,174 A 4/1988 Castonguay et al.
4,786,885 A 11/1988 Morris et al.
4,945,325 A * 7/1990 Toda ..... H01H 71/50 335/16
4,951,020 A * 8/1990 Changle ..... H01H 71/525 335/167
5,089,795 A * 2/1992 Morgan ..... H01H 9/0072 335/193
5,117,211 A 5/1992 Morgan et al.
5,131,504 A 7/1992 Yoo et al.
5,142,112 A * 8/1992 Parks ..... H01H 71/501 200/401
5,193,043 A * 3/1993 Grunert ..... H01H 83/223 361/105
5,210,385 A * 5/1993 Morel ..... H01H 9/383 218/9
5,359,161 A 10/1994 Leach et al.
5,517,164 A * 5/1996 Zoller ..... H01H 77/105 218/22
5,844,187 A 12/1998 Thornton
5,899,323 A * 5/1999 Rakus ..... H01H 1/226 200/244
6,034,586 A * 3/2000 Runyan ..... H01H 71/1027 218/152
6,239,676 B1 * 5/2001 Maloney ..... H01H 71/7436 335/35
6,274,833 B1 * 8/2001 Moody ..... H01H 71/0228 200/401
6,689,979 B1 2/2004 Bach et al.
6,870,115 B1 * 3/2005 Slepian ..... H01H 71/528 200/303
8,222,983 B2 7/2012 Zhou et al.
8,264,232 B2 9/2012 Rival
8,542,083 B2 * 9/2013 Maloney ..... H01H 71/522 335/167
2009/0128265 A1 * 5/2009 Sudhakar ..... H01H 71/2409 335/8

* cited by examiner

CIRCUIT BREAKERS WITH MOVING CONTACT HAVING HEEL-TOE ACTION

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. As long as the stationary and movable contacts are in physical contact, current passes from the stationary contact to the movable contact and out of the circuit breaker to down-line electrical devices.

In the event of an overcurrent condition (e.g., a short circuit), extremely high electromagnetic forces can be generated. The electromagnetic forces repel the movable contact away from the stationary contact. Because the movable contact is fixedly attached to the rotating arm, the arm pivots and physically separates the stationary and movable contacts, thus tripping the circuit. Upon separation of the contacts and blowing open the circuit, an arcing condition occurs. The breaker's trip unit will trip the breaker which will cause the contacts to separate.

SUMMARY OF EMBODIMENTS OF THE INVENTION

Embodiments of the invention are directed to circuit breakers with moving contacts having heel-toe action which are configured to direct arcing across a small portion of a stationary contact surface to arc chutes to thereby alleviate deterioration due to arcing and improve conductivity of a major portion of the stationary contact and moving contact surface over time.

Embodiments of the invention are directed to circuit breakers that include a moveable contact arm. The contact arm has first and second cooperating arm members coupled together. The first arm member engages a pivotable handle and the second arm member comprising an electrical contact. The second arm member can move inward and outward relative to the first arm member.

A lower end portion of the first arm member can be pivotably attached to an upper end portion of the second arm member.

The circuit breaker can include a stationary contact and an arc chute. Only a toe portion of the second arm member last engages a lower edge portion of a stationary contact prior to separation from the stationary contact when the arm moves toward an "OFF" position and/or in an opening position to thereby direct arcing into the arc chute and avoid arcing across a surface of the stationary contact above the lower edge portion.

Adjacent ends of the first and second cooperating arm members can be coupled together in a manner that allows an upper end of the second arm member to move inward and outward and up and down relative to a lower end portion of the upper arm member.

The circuit breaker can include a sleeve affixed to a lower end portion of the first arm member. The sleeve can have a slot. The second arm member can also include a slot. The slot of the sleeve and the slot of the second arm member can be aligned so as to allow a pin to extend therethrough and allow the pin to travel inward, outward, upward and downward to place the second arm member in different positions.

The first arm member can hold a lower end of mechanism spring and can have a curvilinear receiving pocket that faces the upper end of the second arm member. The mechanism spring and/or another spring attached to the first arm member can apply a downwardly extending first force vector to the second arm member. The second arm member can engage a spring configured to apply an upwardly extending second force vector in a direction opposing the first force vector.

The spring that applies the second force vector can extend off a back surface of the first arm member down about a back surface of the second arm member.

An upper segment of the second arm member can be spaced apart from the lower segment of the first arm member at the coupling of the first and second arm members.

The second arm member can include an upwardly extending slot that is aligned with a cooperating slot in a sleeve attached to the first arm member or to a slot in the first arm member. A pin can extend through the slots and the pin in the cooperating slots allows the second arm member to translate relative to the first arm member.

The circuit breaker can include a spring that is attached to and extends below the first arm member behind an upper end portion of the second member to force the second arm member to rotate forward.

The circuit breaker can include a mechanism spring held by a lower end of the first arm member. The first arm member can include a knee that resides above the lower end of the first arm member that faces the mechanism spring.

The circuit breaker can include a mechanism spring held by a lower end segment of the first arm member. The lower end segment of the arm member can have a smaller width than a width of the second arm member adjacent thereto and resides spaced apart a distance from an adjacent underlying portion of the second arm member.

Other embodiments are directed to methods of operating a circuit breaker. The methods include: (i) placing only a toe segment of a moving contact against a stationary contact at a lower edge portion of the stationary contact immediately prior to an arcing action; and (ii) directing all arcing down into an adjacent arc chute providing an arc-free contact surfaces above the toe segment of the moving contact and above the lower edge portion of the stationary contact.

The placing step can be carried out by using a moveable contact arm having first and second arm members coupled together, the placing comprises translating the second arm member relative to the first arm member.

The placing step can be carried out by using a moveable contact arm having first and second arm members pivotably coupled together by pivoting the second arm member relative to the first arm member.

The placing step can be carried out by using a moveable contact arm having first and second arm members coupled together with at least one pin and cooperating slots. The pin can travel in the slots allowing the second arm member to travel through different positions.

The placing step can be carried out using a moveable contact arm having an upper arm member coupled to a lower arm member and applying spring force vectors to only the lower arm member that (i) push an inner facing surface of the lower arm member downward and (ii) push an outer facing surface of the lower arm member inward.

The method can include applying a first spring force against a lower arm member of a moveable contact arm to rotate the lower arm member clockwise when opening and applying a second spring force using a main mechanism spring attached to an upper arm member of the moveable contact arm, the lower arm member configured to move inward, outward and up and down relative to the upper arm member whereby the second spring force is stronger than the first spring force so as to rock the lower arm member counter clockwise once in an "ON" position.

Still other embodiments are directed to circuit breakers that include a housing, a pivotable handle held by the housing and a moveable contact arm held in the housing. The arm has first and second cooperating arm members. The first arm member engages the pivotable handle and the second arm member includes an electrical contact and is configured to be able to translate inward and outward and/or pivot relative to the first arm member. The circuit breaker also includes a stationary contact in the housing configured to engage the electrical contact of the second arm member. At least one of the stationary contact or the second arm electrical contact includes silver in an amount between about 35, and 97%.

An upper portion of the second arm member can be pivotably attached to a lower portion of the first arm member. Only a toe portion of the second arm member electrical contact engages only a lower edge portion the stationary contact when the arm moves toward an OFF position and/or in an opening position to thereby direct arcing into the arc chute and avoid arcing across a surface of the stationary contact above the lower edge portion.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner These and other objects and/or aspects of the present invention are explained in detail in the specification set forth below.

DETAILED DESCRIPTION OF EMBODIMENTS OF THE INVENTION

Figure 1A:
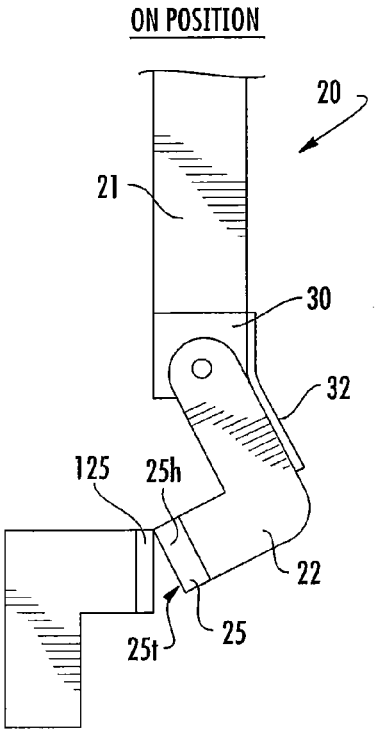
FIG. 1A is a schematic illustration of a conductive arm of a circuit breaker with a moving contact in an exemplary "ON" position according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings. In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 1B:
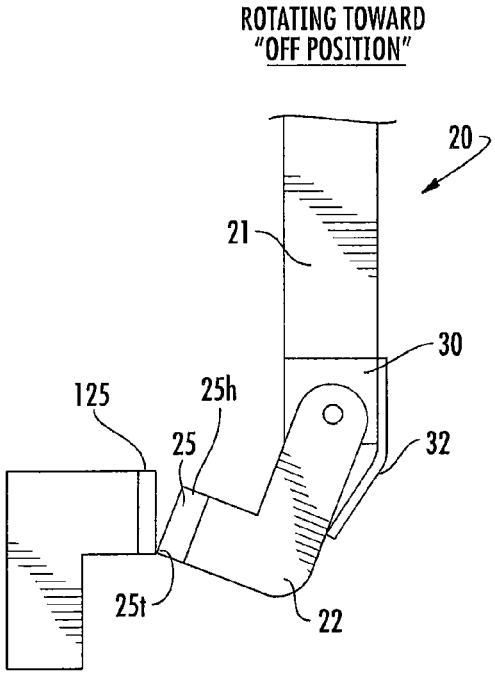
FIG. 1B is a schematic illustration of the conductive arm shown in FIG. 1A with the arm rotating toward an "OFF" position according to embodiments of the present invention.
Figure 2:
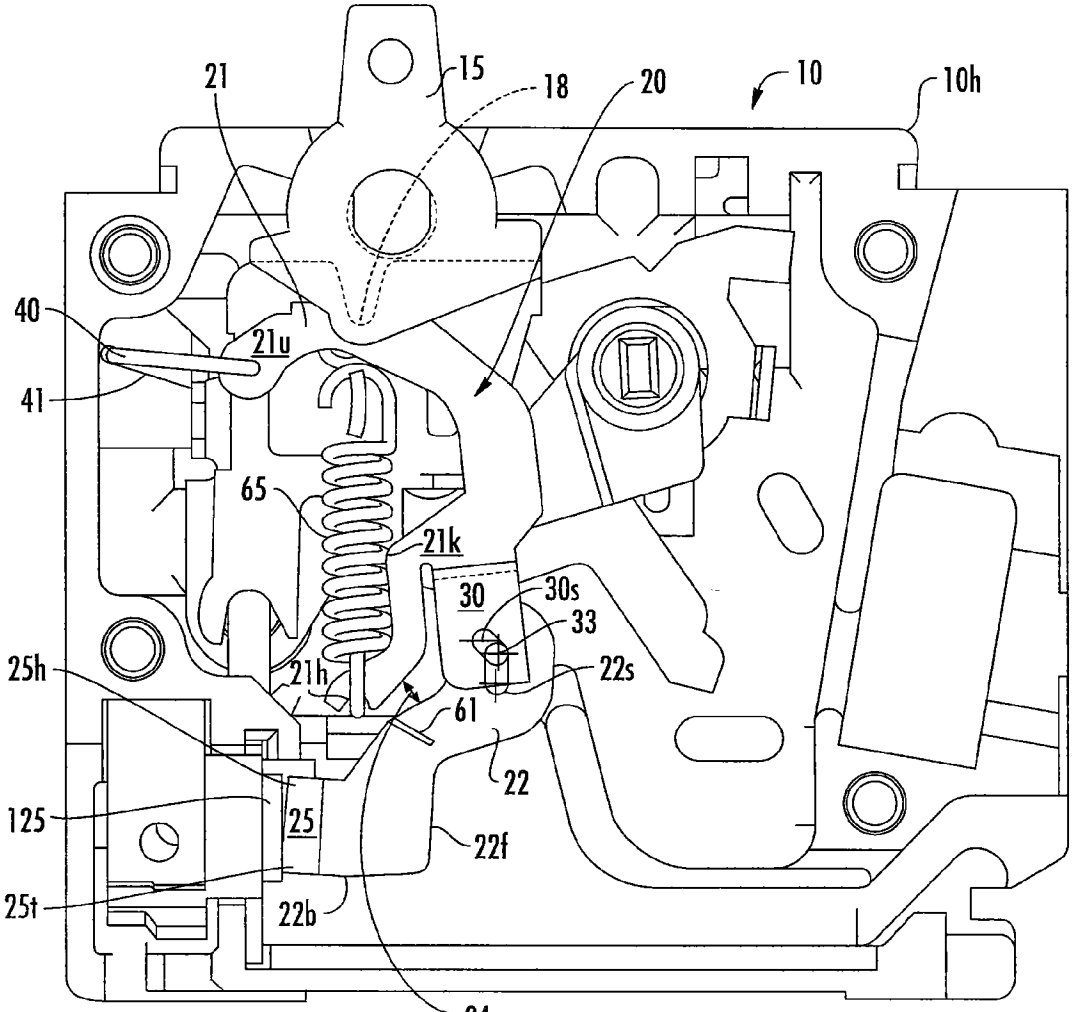
FIG. 2 is a side cutaway view of an exemplary circuit breaker with the handle and conductive arm rotating toward an "OFF" position according to embodiments of the present invention.
Figure 3:
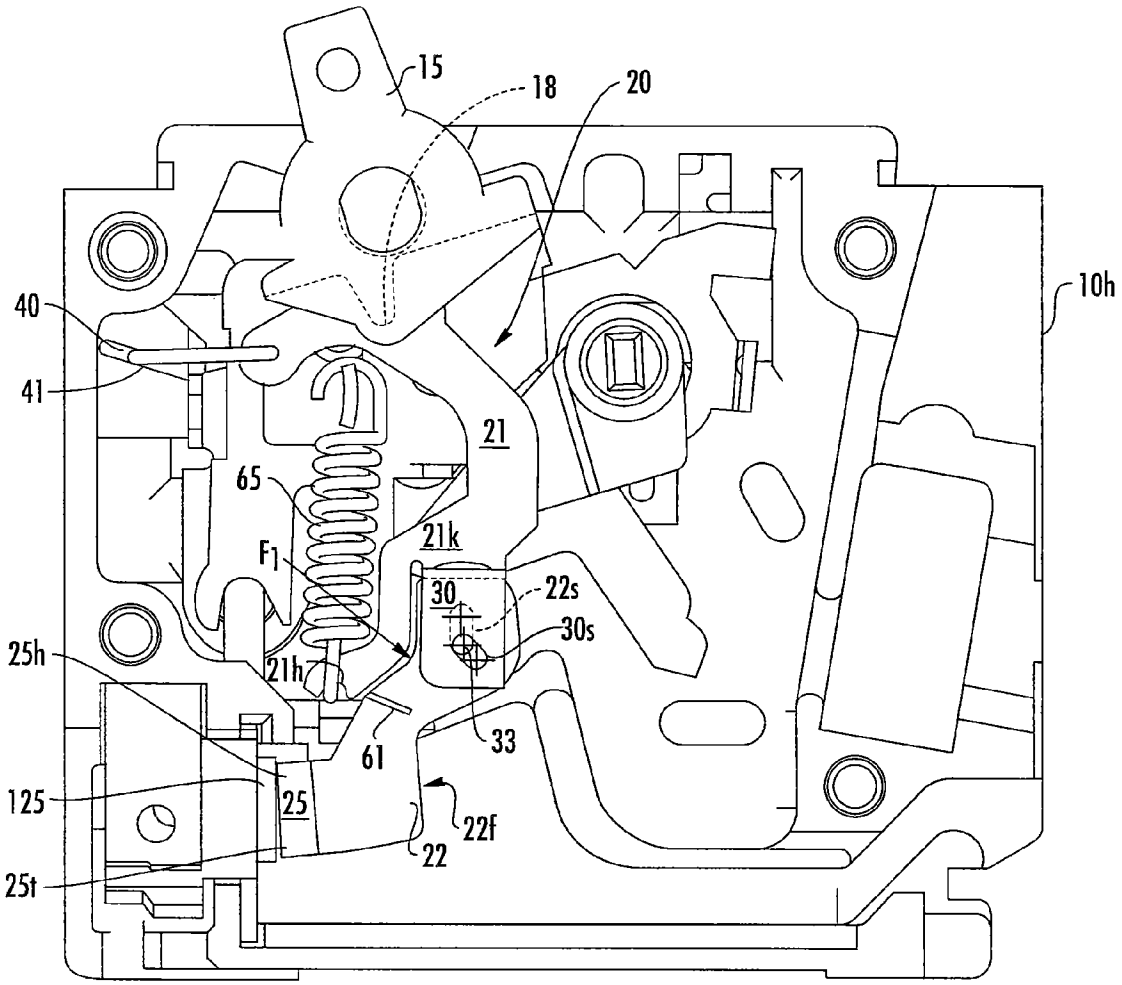
FIG. 3 is a side cutaway view of the exemplary circuit breaker shown in FIG. 2 with the handle and conductive arm in an exemplary "ON" position according to embodiments of the present invention.

Turning now to the figures, FIGS. 1A and 1B illustrate an exemplary configuration of a conductive moving arm 20 with a (moving) contact 25 for a circuit breaker 10 (FIGS. 2 and 3, for example). As shown, the conductive arm 20 has first and second discrete cooperating arm members 21, 22.

As shown in FIGS. 2-7, the circuit breakers 10 have handles 15 that cooperate with a respective moving conductive arm 20. The handle 15 pivots and the arm 20 rotates between "OFF" and "ON" positions, and, optionally, a "TRIP" position. During endurance testing per UL 489, the arm 20 rapidly repetitively moves through its operative positions. Operational requirements from UL's "X" Program called "Overload" currently requires a breaker to be toggled 50, times at six (6) times rated current. For example, for a 150 Ampere (Amp) breaker, the six (6) times test current is 900, Amps, which is arcing the contacts 25, 125 fifty (50) times. Afterwards, a temperature rise test is performed and the temperature rise cannot exceed 50, degrees C.

FIGS. 2 and 3 illustrate an exemplary circuit breaker 10 with a housing 10*h*, handle 15, moveable conductive contact arm 20 that fits over a handle bearing segment of the handle 18. The handle bearing segment 18 allows the handle 15 and arm 20 to move while the handle 15 remains in contact with the arm 20.

The handle 15 can be associated with a disconnect operator (e.g., an operating handle) connected to an assembly for opening and closing separable main contacts in a circuit breaker 10 or for turning power "ON" and "OFF" using a switch associated with a fuse. The circuit breaker 10 can be for a motor starter unit or feeder unit, for example. It is noted that not all circuit breakers 10 require a "TRIP" position (e.g., fused disconnect switches), so in some embodiments, the arm 25 and handle 15 can include only two operative positions, "ON", "OFF," rather than "ON," "OFF" and "TRIP" positions.

Turning back to FIGS. 1A and 1B, the first and second arm members 21, 22, are configured to movably cooperate so that the moving contact 25 can have only a heel 25*h*, contact surface in the "ON" position (FIG. 1A) and a only a toe contact surface 25*t*, (FIG. 1B) as the arm 20 rotates toward the "OFF" position.

Embodiments of the invention are configured to keep the arc at the "toe" of the contact 25*t*, which is at the bottom of the breaker, close to the arc chute 75 (FIG. 8)*where*, the arc needs to jump to. Embodiments of the invention keep the "heel" of the contact 25*h*,, at the top, to be kept in pristine condition without any damage from arcing (or at least substantially reduced from conventional breakers). Embodiments of the invention configure the arm 20 to have a low or minimal resistance to allow for a cool (relatively low temperature) device. In conventional circuit breakers, the contacts 25 open exactly opposite: the "ON" position is at the toe 25*t*, position and the "opening" position is located at the heel 25*h*, (at the top of the contact 25), but the arc chutes 75 (FIG. 8) are at the bottom, e.g., close to the toe 25*t*,, so this can draw an arc from the top or heel 25*h*, position and down (across) the face of both contacts 25, 125 to the bottom/toe position 25*t*, where it then jumps into the arc chute 75. Advantageously, embodiments of the present application configure the moving arm 20 to arc across only a small region at the toe 25*t*, and avoid arcing across a major portion of the faces (most or all of the contact surfaces above the toe 25*t*) of the contacts 25, 125.

During endurance testing per UL 489, the arm 20 rapidly repetitively moves through its operative positions. Operational requirements from UL's "X" Program called "Overload" currently requires a breaker to be toggled 50, times at six (6) times rated current. For a 150, Amp breaker, the six (6) times test current is 900, Amps, which is arcing the contacts 25, 125 fifty (50) times. Afterwards, a temperature rise test is performed and the temperature rise cannot exceed 50, degrees C. It is contemplated that the new cooperating arm members 21, 22 will meet the Overload temperature rise requirement, and, indeed, be able to operate at a maximum temperature rise defined by the noted UL Overload test of 50, degrees C.

The effectiveness of contact performance is typically directly proportional to the amount of silver in the contacts, which can be an expensive component of a breaker 10. Embodiments of the invention allow a reduction in the percentage of silver in the contacts 25, 125, potentially allowing for a substantial cost reduction. Today some contacts are 50% Ag, although 70% and up to 97% may be useful. It is contemplated that the contacts can have Ag in a range as low as about 35%. Embodiments of the invention can have contacts with Ag content between about 35% and 97%, including about 35%, about 40%, about 45%, about 50%, about 55%, about 60%, about 65%, about 70%, about 75%, about 80%, and about 90%.

In some embodiments, in the "ON" position (FIG. 1A), the cooperating arm members 21, 22 are configured so that the heel 25*h*, is touching the stationary contact 125 and as the arm 20 travels to the "OFF" position, a resilient member 32 such as, but not limited to, a spring, can force the lower/second member 22 to rock in an opposing direction so that the other end of the contact will separate and arc. Once the arm 20 travels back to the "ON" position, the contact 25 of the second arm member 22 can once again reside upon a fresh, typically arc-free virgin surface as arcing across the face has been avoided or greatly diminished.

FIGS. 2-6 illustrate a circuit breaker 10 with the conductive moving arm 20 and cooperating arm members 21, 22. In these embodiments, the cooperating arm members 21, 22 are attached with a sleeve 30 that can have a slot 30*s*. The second/lower arm member 22 can also have a slot 22*s*. A pin 33 can engage both slots 30*s*,, 22*s*, and allow the arm members 21, 22 to travel to place the heel and toe 25*h*,, 25*t*, at the desired positions to avoid arcing across the face of the contacts.

Figure 4:
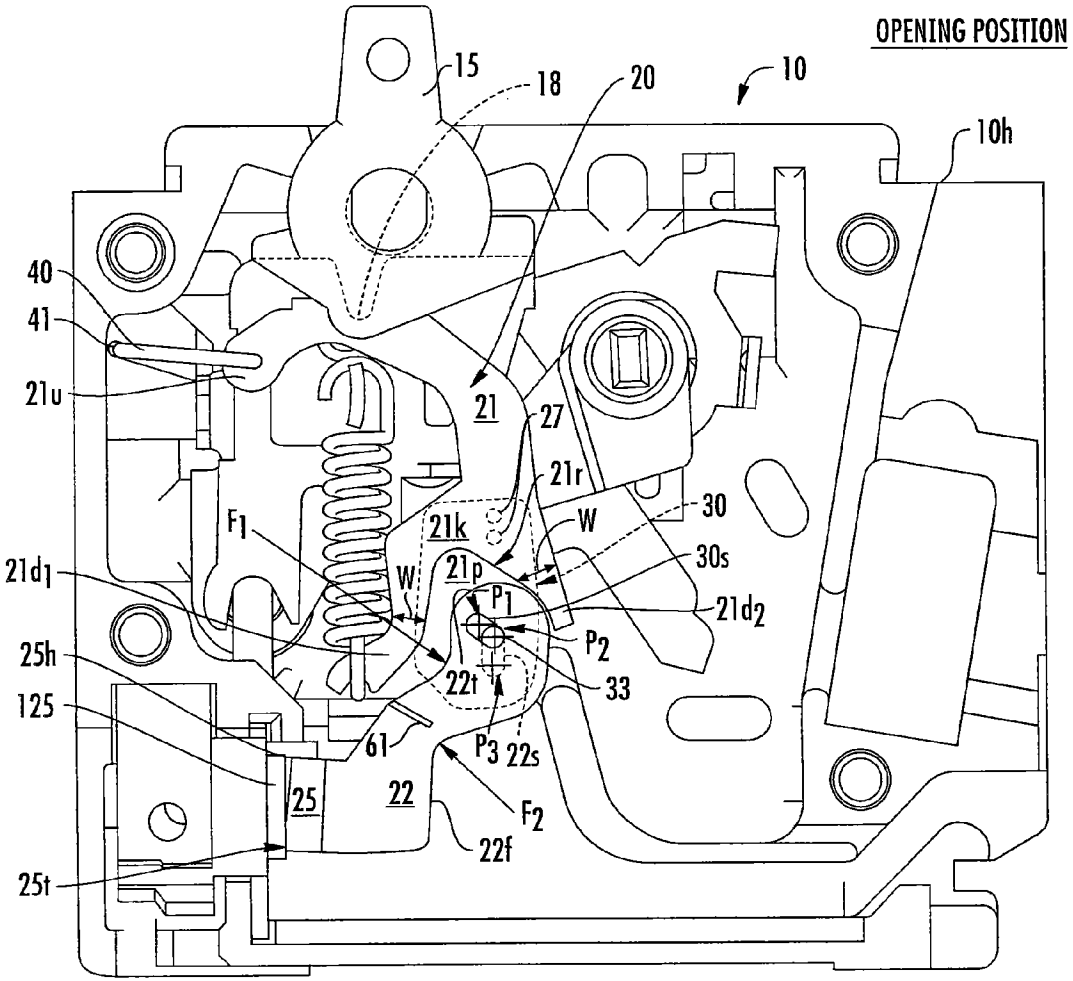
FIG. 4 is a side perspective view of the circuit breaker similar to that shown in FIGS. 2 and 3 but illustrated without the connecting sleeve (in an exemplary opening position) to show exemplary features of embodiments of the cooperating arm components of the conductive arm according to embodiments of the present invention.

The sleeve 30, where used, can be pinned, screwed, nailed, riveted (27, FIG. 4), welded, brazed, adhesively attached or combinations thereof or otherwise fixedly secured to a lower end portion of the upper/first arm member 21. The lower end of the first member 21*l* can have a spring engagement feature 21, such as a hook, to engage the lower end of the mechanism spring 65. The lower end portion of the first/upper member 21*l*, can have a curvilinear pocket 21*p*, (FIG. 4) that extends inward from the spring engagement feature 21*h*, that can slidably receive the upper end portion 22*t*, of the lower/second arm member 22. As shown in FIG. 4, the upper end portion 22*t*, of the lower arm member facing the pocket 21*p*, of the upper arm member 21 can have a curved shape and can hold the elongate slot 22*s*.

Referring to FIG. 2, when the toe 25*t*, engages the lower end of the stationary contact 125 as the arm 20 rotates toward the OFF position (e.g., corresponding to the configuration shown in FIG. 1B), the lower end of the first/upper arm member 21 adjacent the second arm member 22 is spaced apart by a gap 24. FIG. 3 illustrates that in the "ON" position, the heel 25*h*, engages the top of the stationary contact 125 and the lower end of the first/upper arm member 21 is closer to the lower arm member 22.

The ramp 21*r*, can be continuously in contact with the upper part of the lower arm 22*t*. The smallest gap size 24 for the hook arm 21*h*, may be such as to provide at least about a 0.020, inch clearance, typically between about 0.020, and 0.050, inches to provide for any tolerance stack up during assembly.

As shown in FIG. 4, the lower end portion 211 can split into two downwardly extending segments 21$d_1$, 21$d_2$, each with a width W that is less than a width of the second arm member 22 at the top, medial or even bottom segments thereof.

Figure 5:
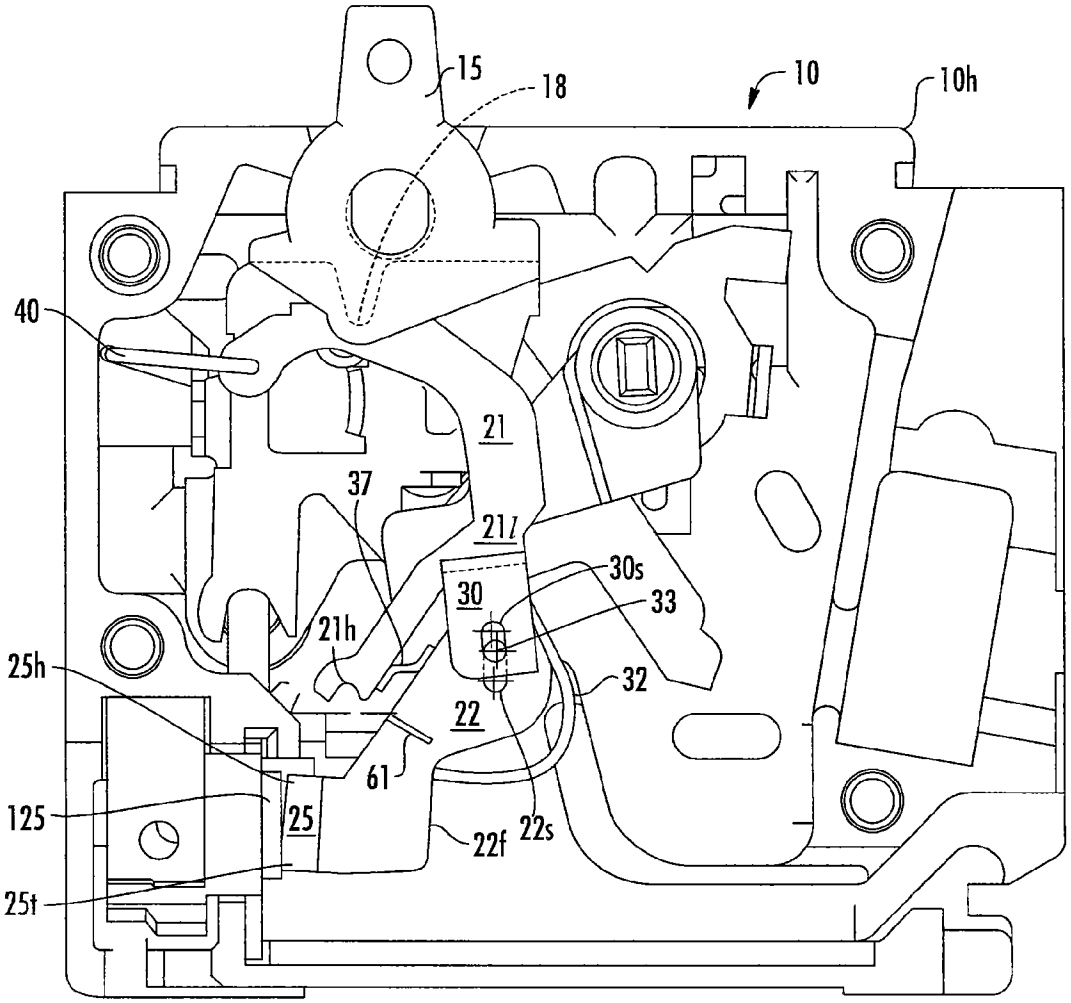
FIGS. 5 and 6 are side cutaway views of another embodiment of the circuit breaker shown without the spring and shown illustrating additional movement/positions of the cooperating arms relative to positions shown in FIGS. 2-4, according to embodiments of the present invention.
Figure 6:
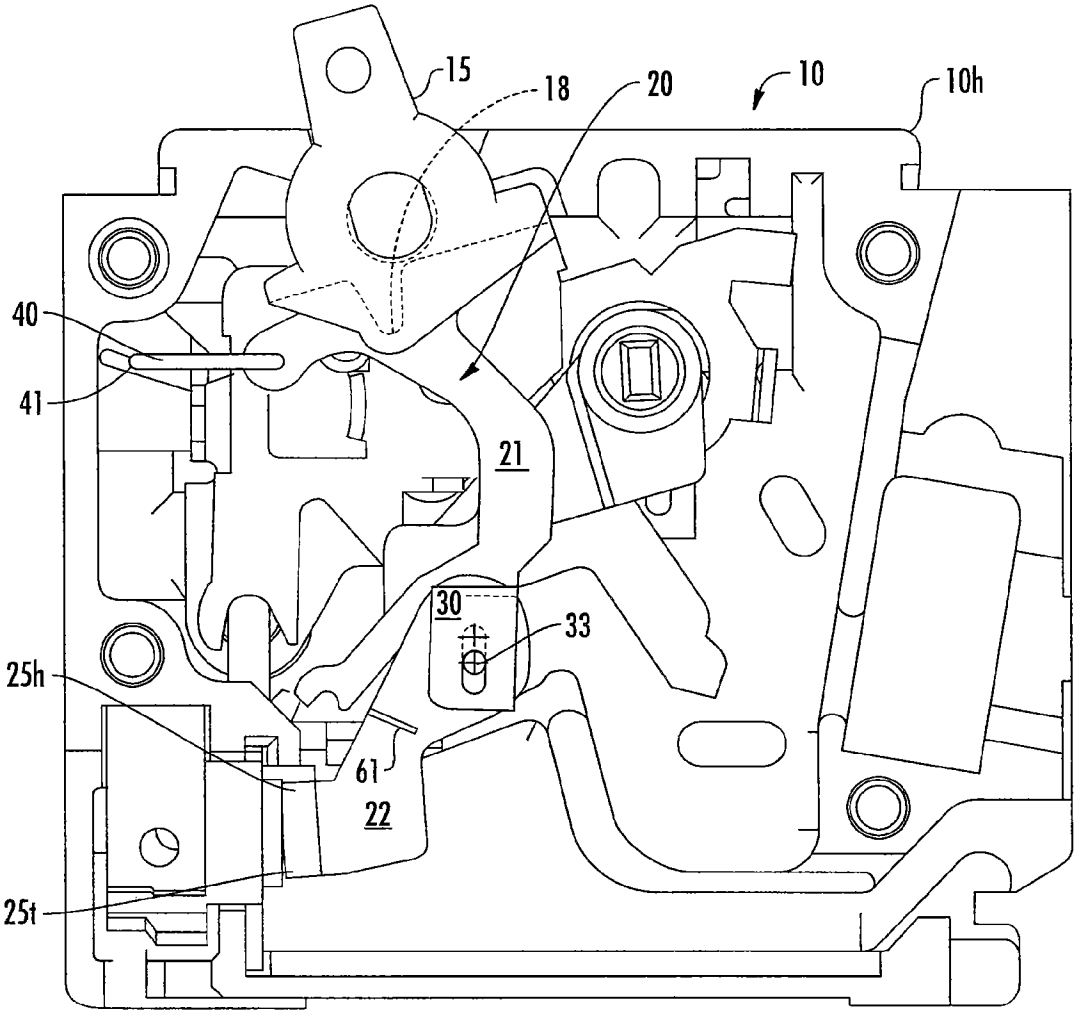
Figure 7:
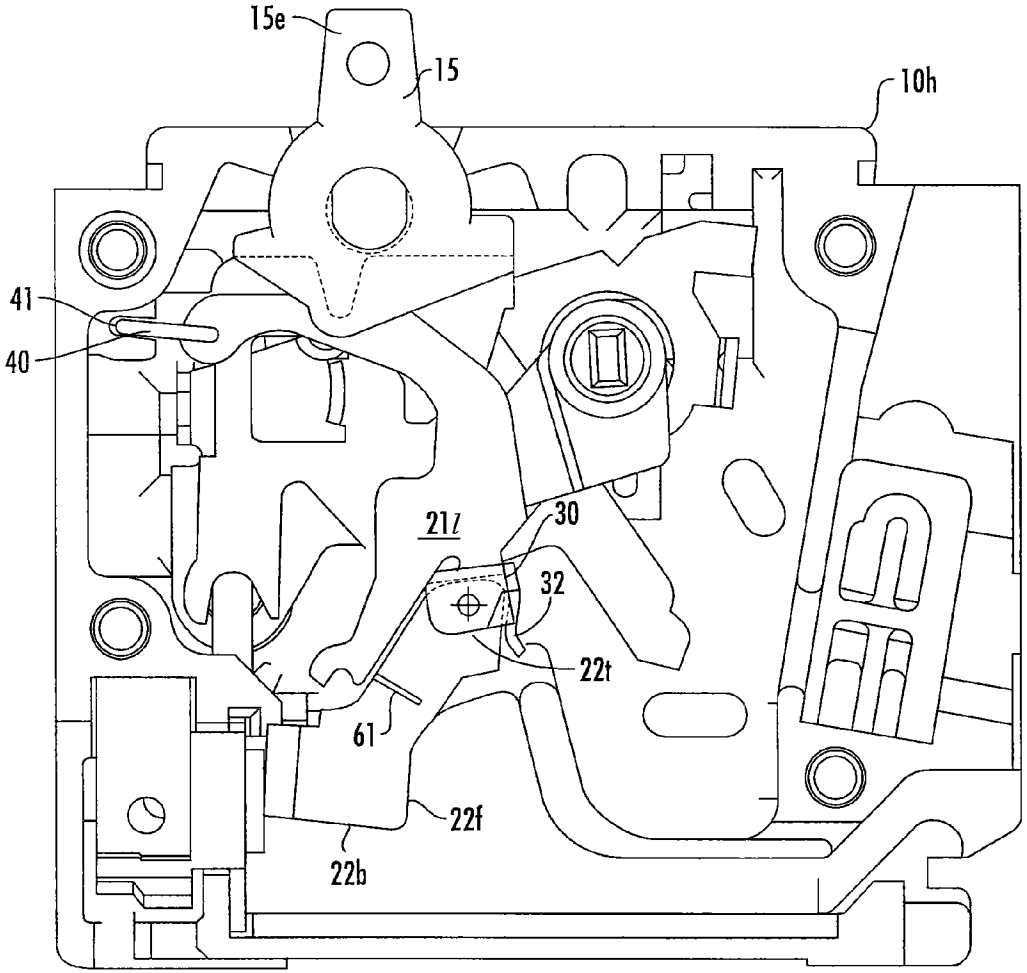
FIG. 7 is a side cutaway view of another embodiment of the circuit breaker also shown without the spring and illustrating another exemplary attachment configuration according to embodiments of the present invention.

FIGS. 2-4 illustrate that the lower end portion of the first/upper arm member 21 can optionally include a knee 21*k*, that faces the mechanism spring 65. FIGS. 5-7 illustrate that the knee 21*k*, is not required. Where used, the knee 21*k*, can be configured to engage the mechanical spring 65 only after full rotation to the heel position 25*h*, of the moving contact 25

FIGS. 2-7 illustrate that the circuit breaker 10 may include a link 40 that is attached to an upper end portion 21*u*, of the first/upper arm member 21. The link 40 can be held in an angled retention channel 41 (shown as angled upward as it travels away from the handle 15 toward the exterior of the housing) in the housing 10*h*. The link 40 can be configured to provide a relatively long break distance. The link 40 and retention channel 41 are not required.

Figure 8:
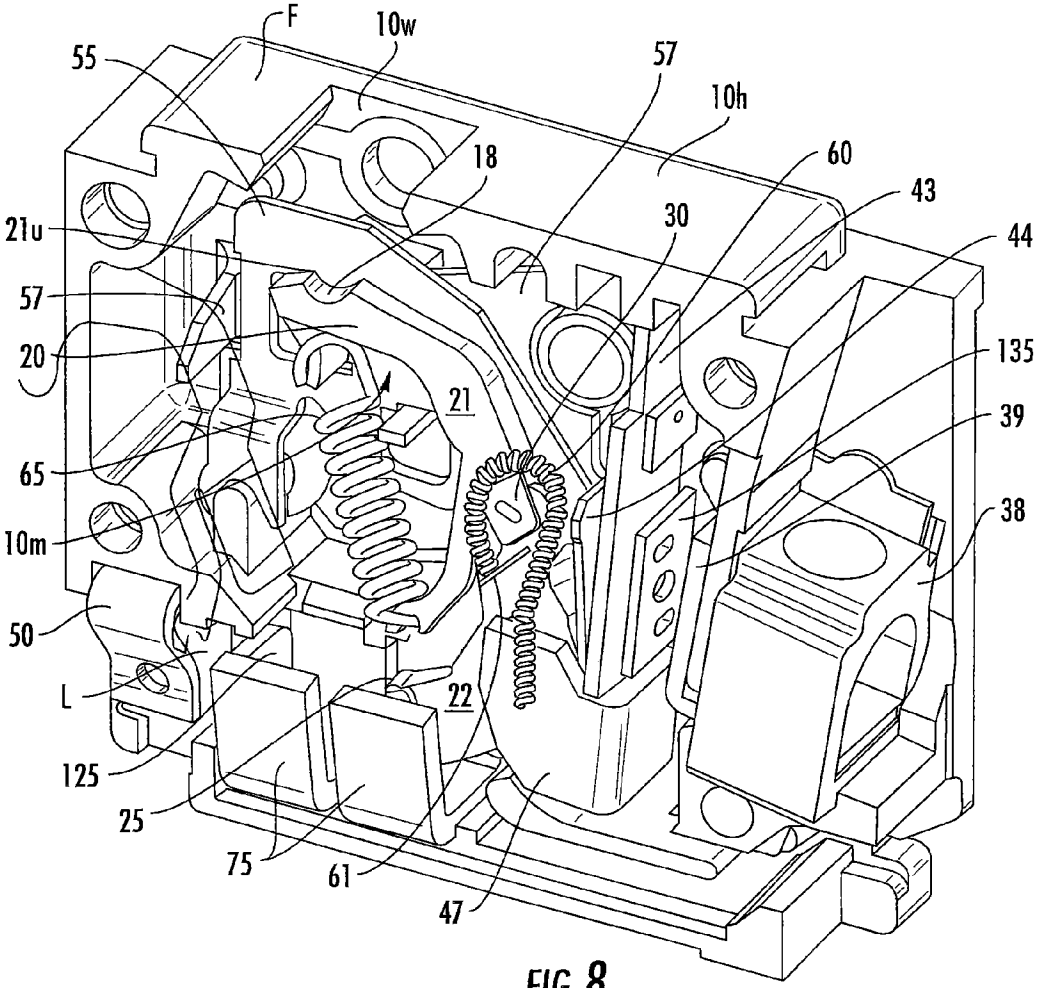
FIG. 8 is a side cutaway isometric view of an exemplary circuit breaker with the cooperating first and second moving arm members illustrating a shunt and other components of a circuit breaker according to embodiments of the present invention.

The lower/second arm member 22 can have a shunt attachment member 61 that engages a shunt 60 (FIG. 8). The lower arm member 22 can also have a flat bottom 22*b*, and a flat side 22 that can be substantially or totally orthogonal to the bottom 22*b*, which may provide a suitable weld surface, where used for such.

FIG. 4 illustrates exemplary positions and exemplary spring force vectors F1, F2 that can be used to provide the desired heel/toe contacts at the defined breaker operational conditions according to embodiments of the present invention. The two slots 30*s*,, 22*s*, cooperate with the pin 33 to be able to move the pin 33 to positions $P_1$, $P_2$, and $P_3$.

Still referring to FIG. 4, spring force vector F1 is configured to force the lower arm member 22 down from position P1 to P2. The ramp 21*r*, of the pocket 21*p*, of the upper arm member 21 is configured to ensure that the lower arm 21 with slot 21*s*, having position P3 does not slide up to P2. The opening position (FIG. 4) can be an important position in the mechanism. This is the exact moment that the contacts 25, 125 start to separate and start to draw an arc (e.g., "immediately prior" to arcing) between the moving and the stationary contacts 25, 125. The steel arc chutes 75 (FIG. 8) magnetically attract this arc and direct (suck) it into the steel, cooling & extinguishing it. Spring force F2 rotates the lower arm 21 clockwise when opening. The force of the main mechanism spring 65 is stronger than spring force F2 so it can rock the lower arm 22 counter clockwise once in the "ON" position.

The lower resilient member or spring 32 (FIGS. 1A, 5, 7) can extend down off the upper arm 21 any suitable distance and can generate the spring force F2. FIG. 5 shows that the spring 32 can extend down below the rear medial portion of the lower arm 22 to provide a force vector F2 in a direction opposing the direction of the spring force vector F1 (FIG. 4). The resilient member or spring 32 can be made of a flat piece of spring steel, such as between about 0.02, and 0.25, inches thick, typically between about 0.03, inches and 0.1, inches thick such as about 0.042, thick or so, bent into the defined shape. It can be a cantilevered piece of flat spring steel that's bent into the desired shape.

A resilient member or spring 37 for transmitting the force vector Fl can reside in the gap space 24 (FIG. 2) above the lower arm member 22 as shown in FIG. 5. The resilient member or spring 37 (e.g., coil or leaf spring) can be attached to a lower end 21$d_1$, of the upper arm 21, typically adjacent the mechanism holding feature 21*h*. However, other placement and attachment configurations may be used.

FIG. 7 illustrates the cooperating arm members 21, 22 can be attached with a sleeve 30 that does not require slots 22*s*,, 30*s*, (FIG. 2, for example). The sleeve 30 is attached to a lower end portion of the upper arm member 21*l*, and an upper end portion of the lower arm member 22*t*. The two arm members 21, 22 are typically pivotably attached together. The resilient member or spring 32 can reside off the sleeve 30 to extend to a back side of the lower arm to provide a bias to force the lower member to kick or rotate forward to a desired operative position. The spring 32 can be a leaf spring or other spring configuration such as formed spring steel or combinations of different spring configurations, e.g., coil and leaf and/or resilient/elastic members.

The heel and toe 25*h*,, 25*t*, can each have a small contact area or point that is tangent T to a line extending off a bottom edge 22*b*, of the second arm member 22. Particularly for the opening configuration (FIG. 4), the toe contact 25*t*, can be less than 30% of the face of the stationary contact 125 at the lower edge of the contacts 25, 125. In some embodiments, small microscopic pin spots of high points of Ag can provide the electrical path in the toe region 25*t*.

Referring to FIG. 8, as is well known, the circuit breaker 10 includes at least one arc chamber 20 having at least one arc chute 30 with arc plates, a mechanism assembly 10*m* with the arm 20 holding the contact 25 (e.g., a moving contact attached to the "contact arm") and the stationary contact 125 proximate a line terminal L. The arm 20 is conductive, typically non-ferromagnetic metal such as, but not limited to, copper. The upper arm member 21 and lower arm member 22 can be formed of the same or different metals. In some embodiments the upper arm member 21 is steel and the lower arm member is or comprises copper.

The handle 15 can include an external portion 15*e*, (FIG. 7) which can comprise a user actuator or input such as a lever, thumb or finger wheel or other suitable configuration. The handle pivot 15*p*, can be attached to the housing directly or indirectly.

The circuit breaker 10 can also include one or more of a magnet 135, a load collar 38, a load terminal 39, a bimetal member 43, an armature 44, a shunt bracket 47, a spring clip 50, a cradle 55 and frame 57. The circuit breaker 10 can have alternate configurations and components.

FIG. 8 also schematically illustrates a shunt 60 attached to the lower arm member 22 and a shunt bracket 47. The shunt 60 can be resilient and/or flexible. FIG. 8 also schematically illustrates a mechanism spring 65 (also shown in FIGS. 2-4) which is part of the operator mechanism 10*m*,, as is well known to those of skill in the art.

The arm 20 and handle 15 can have defined operative positions, "OFF," "ON" and (optionally) "TRIP". The movements can be over a desired handle angulation, typically between about 45, degrees to about 90, degrees, more typically about 90, degrees between the "OFF" and "ON" positions with the "TRIP" position between the "OFF" and "ON". In the "ON" position, the arm 20 places the moveable contact 25 in abutting contact with the stationary contact 125. In the "OFF" position, the arm 20 rotates to move the moveable contact 25 away from the stationary contact 125. In the "TRIP" position, the arm 20 also positions the moveable contact 25 away from the stationary contact 125, typically a distance greater than the spaced apart distance of the two contacts 25, 125 in the "OFF" position.

Typically, in use, the face F (FIG. 8) of the housing/circuit breaker is oriented to be vertical with the handle facing outward.

Figure 9A:
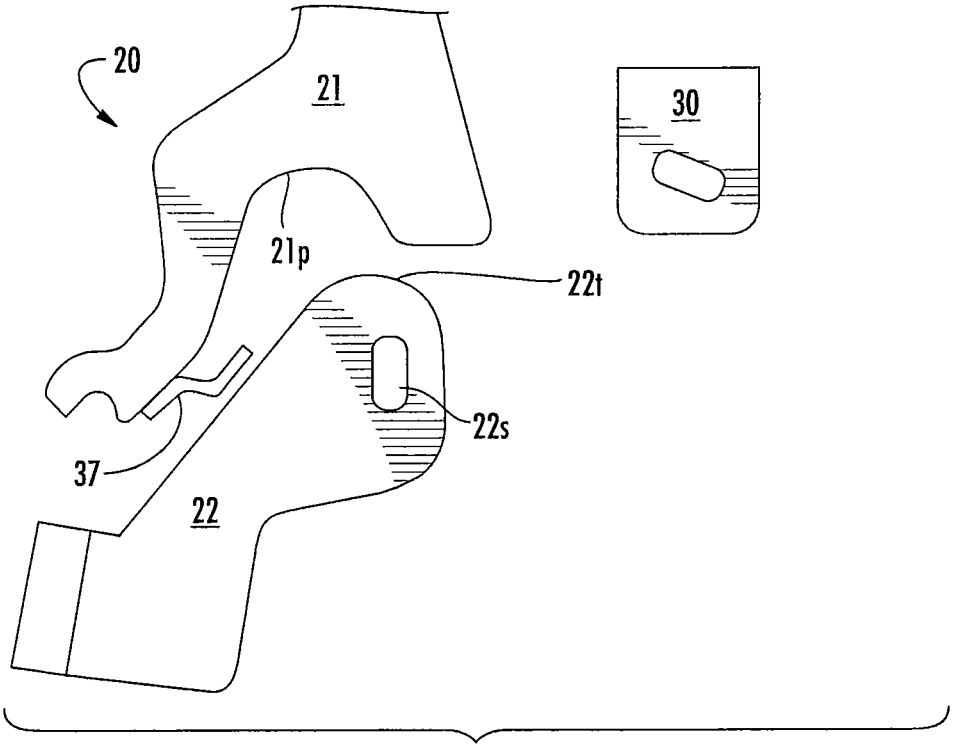
FIGS. 9A and 9B are schematic illustrations of cooperating arm members according to embodiments of the present invention.
Figure 9B:
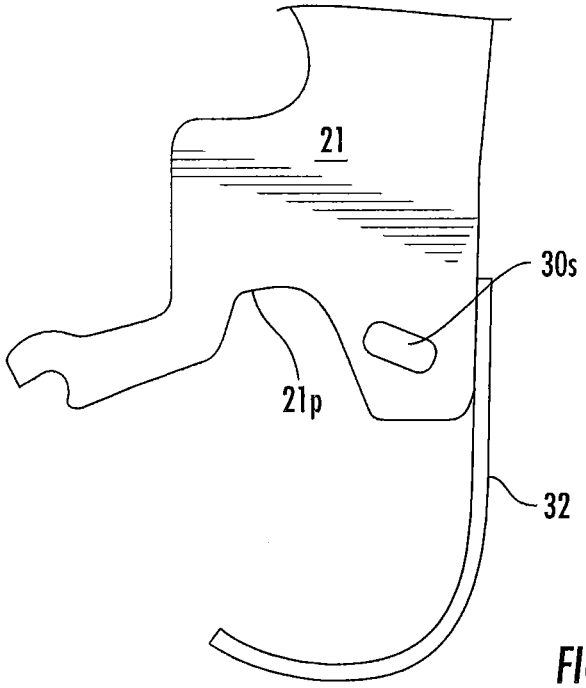

FIG. 9A is a schematic view of components of the conductive arm 20, including the upper arm member 21, the lower arm member 22 and the sleeve 30. The resilient member 37 for F1 can optionally be attached to the upper arm member 21 as shown. FIG. 9B illustrates that the sleeve 30 is not required and the upper member 21 can have an integral portion configured to provide the attachment and slot for the lower arm member 21. While embodiments of the arm members 21, 22 and exemplary attachment configurations have been described, other attachment arrangements and configurations of the upper and lower arm members are contemplated.

In some embodiments, the circuit breakers 10 can be DC circuit breakers, AC circuit breakers, or both AC (alternating current) and DC (direct current) circuit breakers.

The circuit breakers 10 can be rated for voltages between about 1V to about 5000 volts (V) DC and/or may have current ratings from about 15, to about 2,500, Amps. The circuit breakers 10 may be high-rated miniature circuit breakers, e.g., above about 70A in a compact package. However, it is contemplated that the circuit breakers 10 and components thereof can be used for any voltage, current ranges and are not limited to any particular application as the circuit breakers can be used for a broad range of different uses.

The circuit breakers 10 can be molded case circuit breakers (MCCB)s. MCCBs are well known. See, e.g., U.S. Pat. Nos. 4,503,408, 4,736,174, 4,786,885,, and 5,117,211,, the contents of which are hereby incorporated by reference as if recited in full herein.

The circuit breakers 10 can be a bi-directional DC MCCB. See, e.g., U.S. Pat. No. 8,222,983,, the content of which is hereby incorporated by reference as if recited in full herein. The DC MCCBs can be suitable for many uses such as data center, photovoltaic, and electric vehicle applications.

As is known to those of skill in the art, Eaton Corporation has introduced a line of MCCBs designed for commercial and utility scale photovoltaic (PV) systems. Used in solar combiner and inverter applications, Eaton PVGard™ circuit breakers are rated up to 600, Amp at 1000, Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating. In some particular embodiments, the circuit breaker 10 can be a high-rating miniature circuit breaker.

Figure 10:
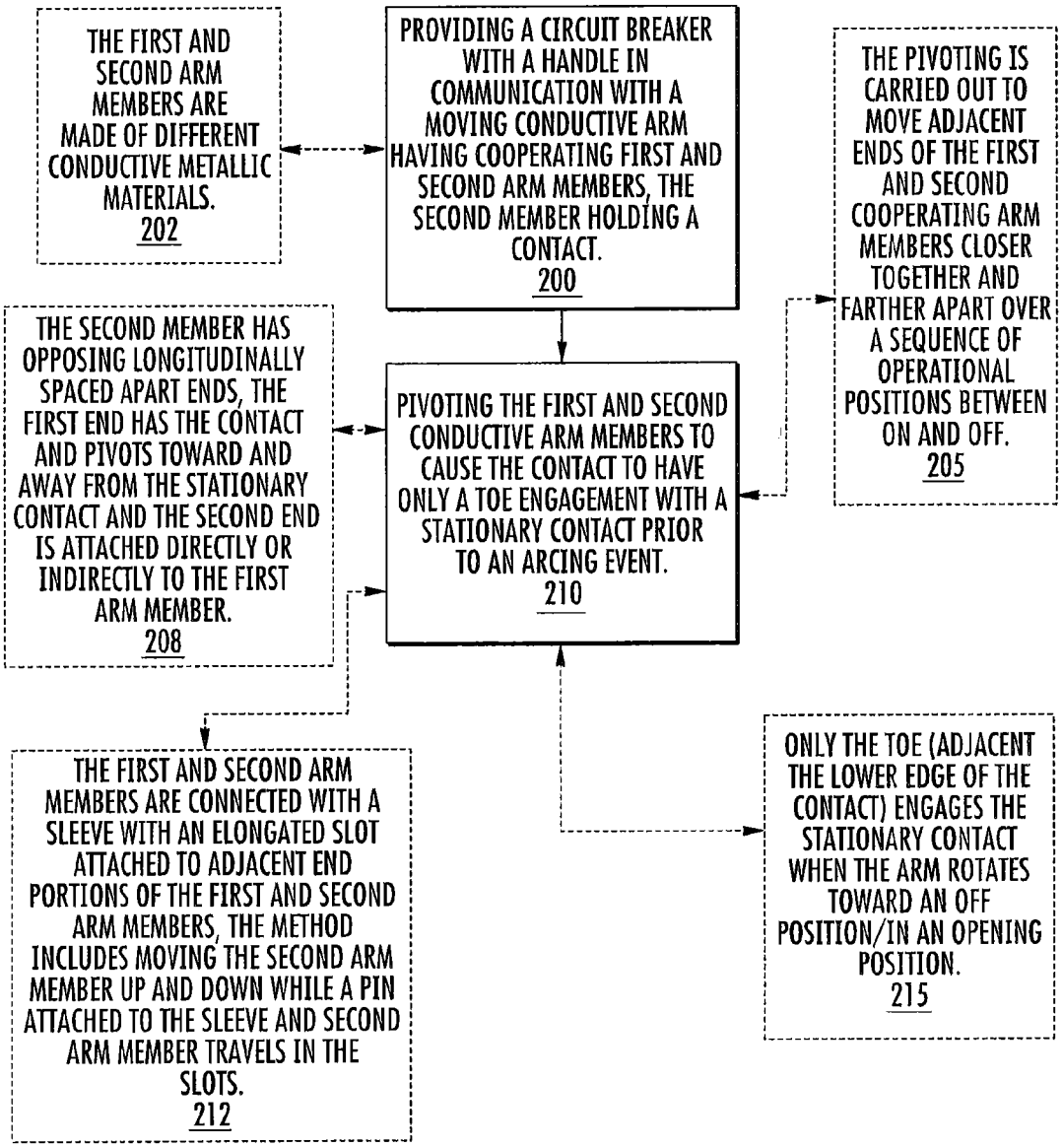
FIG. 10 is a flow chart of operational steps that can be used to operate a circuit breaker according to embodiments of the present invention.

FIG. 10 is a flow diagram of exemplary steps that can be used to operate a breaker. A circuit breaker with a handle in communication with a moving conductive arm having cooperating first and second arm members is provided. The second member holds an electrical contact (block 200). The first and second conductive arm members are pivoted relative to each other to cause the contact to have only a toe engagement with a stationary contact just prior to an arcing event (block 210).

The pivoting can be carried out to move adjacent ends of the first and second cooperating arm members closer together and farther apart over a sequence of operational positions between ON and OFF (block 205).

The first and second arm members can be made of different conductive metallic materials (block 202).

The second arm member can have opposing longitudinally spaced apart ends, the first end has the contact and pivots toward and away from the stationary contact and the second end is attached directly or indirectly to the first arm member (block 208).

The first and second arm members can be connected with a sleeve with an elongate slot attached to adjacent end portions of the first and second arm members. The method can include moving the second arm member up and down while a pin attached to the sleeve and second arm member travels in the slot (block 212).

Only the toe (adjacent the lower edge of the contact) can engage the stationary contact when the arm rotates toward an OFF position/in an opening position to thereby direct arcing directly into the arc chutes avoiding virgin contact surfaces thereabove (block 215).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker comprising:

a moveable contact arm, the contact arm having first and second cooperating arm members coupled together, the first arm member having a first end portion engaging a pivotable handle and a spaced apart second end portion coupled to the second arm member, wherein the second arm member comprises an electrical contact, wherein the second arm member can move inward and outward and up and down relative to the first arm member, wherein the second arm member has a free end spaced apart from the first arm member that holds the electrical contact, wherein the second arm member has a shape that places the free end of the second arm member a distance forward of the second end portion of the first arm member, wherein the electrical contact has an outwardly facing contact surface with a heel and a toe, the heel on an opposing side of the contact surface from the toe, wherein the toe is closer to an arc chute than the heel, and wherein, in operation, (i) the second arm member moves relative to the first arm member to position the heel forward of the toe in an ON position of the circuit breaker for a heel only contact with a stationary contact and (ii) the second arm member moves relative to the first arm member to position the toe forward of the heel for a toe only contact with the stationary contact when the contact arm rotates toward an OFF position to thereby direct arcs across only the toe of the contact surface of the electrical contact.

2. The circuit breaker of claim 1, wherein a lower end portion of the first arm member is pivotably attached to an upper end portion of the second arm member, and wherein the free end of the second arm member resides a distance forward of the first arm member in the ON position, the rotating toward OFF position and an OFF position.

3. The circuit breaker of claim 1, further comprising an arc chute, and wherein only the toe of the electrical contact of the second arm member in the toe only contact last engages only a lower edge portion of the stationary contact prior to separation from the stationary contact when the contact arm moves toward the OFF position and in an opening position to thereby direct arcing into the arc chute and avoid arcing across a surface of the stationary contact above the lower edge portion.

4. The circuit breaker of claim 1, wherein adjacent ends of the first and second cooperating arm members are coupled together in a manner that allows an upper end of the second arm member to move inward and outward and up and down relative to a lower end portion of the upper arm member.

5. The circuit breaker of claim 1, further comprising a sleeve affixed to a lower end portion of the first arm member, the sleeve having an elongate slot, wherein the second arm member comprises an elongate slot, and wherein the slot of the sleeve and the slot of the second arm member are aligned so as to allow a pin to extend therethrough and allow the pin to travel inward toward the stationary contact and an arc chute, outward away from the stationary contact and arc chute, upward toward the handle and downward to place the second arm member in different positions.

6. The circuit breaker of claim 1, wherein the first arm member holds a lower end of mechanism spring and has a curvilinear receiving pocket that faces the upper end of the second arm member, and wherein the second arm member engages a spring configured to apply an upwardly extending force vector.

7. The circuit breaker of claim 6, wherein the spring is a first spring, and the circuit breaker further comprises a second spring that is attached to the first arm member and applies a downwardly extending force vector to the second arm member in a direction opposing the force vector applied by the first spring, wherein the second spring extends off a back surface of the first arm member down about a back surface of the second arm member.

8. The circuit breaker of claim 1, wherein an upper segment of the second arm member is spaced apart from a lower segment of the first arm member at the coupling of the first and second arm members.

9. The circuit breaker of claim 1, wherein the second arm member comprises an upwardly extending elongate slot that is aligned with a cooperating elongate slot in a sleeve attached to the first arm member or to a cooperating elongate slot in the first arm member, and wherein a pin extends through the slots and allows the second arm member to translate relative to the first arm member.

10. The circuit breaker of claim 2, further comprising a spring that is attached to and extends below the first arm member behind an upper end portion of the second member to force the second arm member to rotate forward.

11. The circuit breaker of claim 1, further comprising a mechanism spring held by a recess in a lower end of the first arm member, wherein the first arm member comprises a knee that resides above the recess of the lower end of the first arm member and that faces the mechanism spring, and wherein the first arm member comprises a curvilinear gap space under the knee spaced apart from the recess in the lower end of the first arm member that holds the mechanism spring.

12. The circuit breaker of claim 1, further comprising a mechanism spring, wherein the first arm member merges into a bifurcated lower end portion with spaced apart first and second segments, wherein the first segment has a recess that holds an end of the mechanism spring, wherein the first segment has a smaller width than a width of the second segment adjacent thereto, and wherein the first segment resides spaced apart a distance from an adjacent underlying portion of the second arm member.

13. A method of operating a circuit breaker, comprising:

providing a moveable contact arm having first and second arm members moveably coupled together so that the second arm member can translate side to side and up and down relative to the first arm member, the second arm member having a free end with an outwardly facing electrical contact surface with a heel and a toe, the heel on an opposing side of the contact surface from the toe, wherein the toe is closer to an arc chute than the heel;

translating the second arm member relative to the first arm member so that a free end of the second arm member holding the electrical contact can move in a heel to toe action, wherein in the heel action, the second member places the heel forward of the toe to place only the heel against the stationary contact, and in the toe action, the toe is forward of the heel to place only the toe against the stationary contact;

placing only the toe against the stationary contact at a lower edge portion of the stationary contact immediately prior to an arcing action; and then directing all arcing down into an adjacent arc chute providing an arc-free contact surfaces above the toe of the moving contact and above the lower edge portion of the stationary contact.

14. The method of claim 13, wherein the second arm member is only supported by the first arm member in the circuit breaker.

15. The method of claim 13, wherein a second end portion of the first arm member is movably coupled to a first end portion of the second arm member with at least one pin and cooperating slots, wherein the pin travels in the slots allowing the second arm member to travel through different positions including up and down and forward and rearward positions, and wherein the second arm member has a shape that places the free end a distance forward of the second end portion of the first arm member.

16. The method of claim 13, wherein the first arm member is an upper arm member and the second arm ember is a lower arm member, wherein the placing comprises applying spring force vectors to the lower arm member that (i) push an inner facing surface of the lower arm member downward and (ii) push an outer facing surface of the lower arm member inward.

17. The method of claim 13, wherein the second arm member is a lower arm member and the first arm member is an upper arm member, and wherein the method comprises applying a first spring force against the lower arm member to rotate the lower arm member clockwise when opening and applying a second spring force using a spring attached to the upper arm member, the lower arm member configured to move inward, outward and up and down relative to the upper arm member whereby the second spring force is stronger than the first spring force so as to rock the lower arm member counter clockwise once in an "ON" position.

18. A circuit breaker comprising:

a housing;

a pivotable handle held by the housing;

a stationary contact in the housing configured to engage the electrical contact of the second arm member; and a moveable contact arm held in the housing, the arm having first and second cooperating arm members, the first arm member engaging the pivotable handle and the second arm member comprising an electrical contact and being configured to be able to translate inward and outward and/or pivot relative to the first arm member, wherein the second arm member has a free end spaced apart from the first arm member that holds the electrical contact, wherein the electrical contact has an outwardly facing contact surface with a heel and a toe, the heel on an opposing side of the contact surface from the toe, wherein the toe is closer to an arc chute than the heel, and wherein, in operation, (i) the second arm member moves relative to the first arm member to position the heel forward of the toe in an ON position of the circuit breaker for a heel only contact with the stationary contact and (ii) the second arm member moves relative to the first arm member to position the toe forward of the heel for a toe only contact with the stationary contact when the contact arm rotates toward an OFF position to thereby direct arcs across only the toe of the contact surface of the electrical contact, wherein at least one of the stationary contact or the second arm electrical contact comprises silver in an amount between about 35 and 97%.

19. The circuit breaker of claim 18, wherein an upper portion of the second arm member is pivotably attached to a lower portion of the first arm member, and wherein only the toe of the second arm member electrical contact engages only a lower edge portion the stationary contact when the arm moves toward the OFF position and/or in an opening position to thereby direct arcing into the arc chute and avoid arcing across a surface of the stationary contact above the lower edge portion, and wherein the second arm member has a shape that places the free end of the second arm member a distance forward of the lower end portion of the first arm member.

20. The circuit breaker of claim 1, wherein the second arm member is supported in the circuit breaker by only the first arm member and is pivotably attached to the second arm member to position the free end portion with the electrical contact adjacent the stationary contact.

21. The circuit breaker of claim 18, wherein the second arm member is supported in the circuit breaker by only the first arm member and is pivotably attached to the second arm member to position the free end portion with the electrical contact adjacent the stationary contact.

22. A circuit breaker comprising:

a moveable contact arm, the contact arm having first and second cooperating arm members moveably coupled together, the first arm member having a first end portion that engages a pivotable handle and a second end portion that is movably coupled to the second arm member, wherein the second arm member has a free end spaced apart from the first arm member that comprises an electrical contact, wherein the second arm member can move inward and outward relative to the first arm member, and wherein the second arm member has a shape that places the free end of the second arm member a distance forward of the second end portion of the first arm member;

a single stationary contact facing the electrical contact of the free end of the second arm member; and an arc chute adjacent the electrical contact of the free end of the second arm member and the stationary contact, wherein the electrical contact of the free end of the second arm member has an outwardly facing contact surface with a heel and a toe, the heel on an opposing side of the contact surface from the toe, wherein the toe is closer to an arc chute than the heel, and wherein, in operation, (i) the second arm member moves relative to the first arm member to position the heel forward of the toe in an ON position of the circuit breaker for a heel only contact with the stationary contact and (ii) the second arm member moves relative to the first arm member to position the toe forward of the heel for a toe only contact with the stationary contact when the contact arm rotates toward an OFF position and/or in an opening position to thereby direct arcs across only the toe of the contact surface of the electrical contact.

* * * * *